US007219659B2

(12) United States Patent
Magel et al.

(10) Patent No.: US 7,219,659 B2
(45) Date of Patent: May 22, 2007

(54) FUEL INJECTION SYSTEM COMPRISING A PRESSURE INTENSIFIER AND A DELIVERY RATE-REDUCED LOW-PRESSURE CIRCUIT

(75) Inventors: Hans-Christoph Magel, Pfullingen (DE); Gerhard Geyer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 131 days.

(21) Appl. No.: 10/528,465

(22) PCT Filed: Jun. 30, 2003

(86) PCT No.: PCT/DE03/02175

§ 371 (c)(1),
(2), (4) Date: Mar. 21, 2005

(87) PCT Pub. No.: WO2004/040118

PCT Pub. Date: May 13, 2004

(65) Prior Publication Data

US 2006/0042598 A1 Mar. 2, 2006

(30) Foreign Application Priority Data

Oct. 17, 2002 (DE) ..... 102 48 467

(51) Int. Cl.
*F02M 37/00* (2006.01)

(52) U.S. Cl. ..... 123/514

(58) Field of Classification Search ..... 123/514
See application file for complete search history.

(56) References Cited

U.S. PATENT DOCUMENTS

| | | | | |
|---|---|---|---|---|
| 4,570,604 | A * | 2/1986 | Thornton et al. | 123/514 |
| 5,285,759 | A * | 2/1994 | Terada et al. | 123/514 |
| 5,794,598 | A * | 8/1998 | Janik et al. | 123/514 |
| 6,142,127 | A * | 11/2000 | Maass | 123/514 |
| 6,622,701 | B2 * | 9/2003 | Endo | 123/467 |
| 7,044,110 | B2 * | 5/2006 | Geyer | 123/514 |

FOREIGN PATENT DOCUMENTS

| | | |
|---|---|---|
| DE | 196 52 831 A | 6/1998 |
| DE | 199 10 970 A | 9/2000 |
| DE | 101 23 911 A | 11/2002 |
| EP | 1 122 424 A | 8/2001 |
| EP | 1 152 142 A | 11/2001 |
| EP | 1 195 514 A | 4/2002 |

* cited by examiner

*Primary Examiner*—Thomas Moulis
(74) *Attorney, Agent, or Firm*—Ronald E. Greigg

(57) ABSTRACT

A fuel injection system for an internal combustion engine, having a fuel injector supplied with fuel from a high-pressure fuel source and including an injection valve member for opening or closing injection openings and a low-pressure circuit with a prefeed pump which pumps fuel from a fuel tank. Partial return fuel quantities, depressurized to the prefeed pressure of the prefeed pump, are delivered to the low-pressure circuit by pressure boosters or by fuel injectors inside an infeed portion via returns.

14 Claims, 3 Drawing Sheets

FUEL INJECTION SYSTEM COMPRISING A PRESSURE INTENSIFIER AND A DELIVERY RATE-REDUCED LOW-PRESSURE CIRCUIT

CROSS-REFERENCE TO RELATED APPLICATIONS

This application is a 35 USC 371 application of PCT/DE 03/02175 filed on Jun. 30, 2003.

BACKGROUND OF THE INVENTION

1. Field of the Invention

This invention relates to an improved fuel injection system for internal combustion engines, including a pressure booster and a reduced quantity low pressure circuit.

2. Description of the Prior Art

Both pressure-controlled and stroke-controlled injection systems are known for supplying combustion chambers of self-igniting internal combustion engines with fuel. As fuel injection systems, not only unit fuel injectors and pump-line-nozzle units but also reservoir injection systems are also used. Reservoir injection systems (common rails) advantageously make it possible to adapt the injection pressure to the load and rpm of the engine. To attain high specific outputs, a high injection pressure is required. The higher the attainable injection pressure, the less are the emissions from the engine.

BACKGROUND OF THE INVENTION

German Patent Disclosure DE 199 10 970 A1 discloses a fuel injection system having a pressure boosting unit, which is located between a pressure reservoir and a nozzle chamber and whose pressure chamber communicates with the nozzle chamber via a pressure line. A bypass line connected to the pressure reservoir is also provided. The bypass line communicates directly with the pressure line. The bypass line can be used for a pressurized injection and is located parallel to the pressure chamber, so that the bypass line is passable, regardless of the motion and position of a displaceable pressure fluid in the pressure boosting unit. This makes greater flexibility in terms of the injection possible.

German Patent Disclosure DE 101 23 911.4 relates to a fuel injection system with a pressure boosting device. A fuel injection system for internal combustion engines includes a fuel injector, which can be supplied from a high-pressure fuel source and has a pressure boosting device. The pressure boosting device includes a movable piston, which divides a chamber connected to the high-pressure fuel source from a high-pressure chamber communicating with the injector. The high-pressure chamber communicates with a differential pressure chamber via a fuel line, so that the high-pressure chamber can be filled with fuel via the differential pressure chamber of the pressure boosting device. The triggering of the fuel injection system with the pressure boosting device known from DE 101 23 911.4 is effected via a pressure relief of the differential pressure chamber of the pressure boosting device. The systems known from DE 199 10 970 A1 and DE 101 23 911.4, include a stroke-controlled fuel injector. Each fuel injector is assigned a pressure booster, for elevating the injection pressure as needed. The triggering of the pressure boosting device is effected via a simple 2/2-way valve and leads to reduced depressurization losses, since the differential pressure chamber of the pressure boosting device is pressure-relieved for its actuation.

Moreover, these systems make it possible to perform multiple injections and to shape the injection course flexibly.

The use of a pressure boosting device in a fuel injection system that includes a common rail leads to a greatly increased fuel quantity demand per fuel injector within the injection system. For a high-pressure pumping unit, the result is an increased pumping quantity at a reduced pressure level. For a low-pressure pump, the pumping quantity also increases. The pressure level of the low-pressure pumping unit, however, does not decrease, since good filling of the pump chambers of the high-pressure pumping unit and exact meterability of the pumping quantity by the metering unit in the fuel system must be assured. Designing the prefeed pump for the large-quantity flows required in fuel injectors with a pressure booster is therefore a problem. In a fuel injection system with a common rail with an integrated pressure booster, high return quantities occur because of the pressure boosting, and these quantities amount to multiple times the fuel quantity to be injected via the respective fuel injector. In the systems known from the prior art, this fuel quantity is depressurized completely and is delivered to the fuel tank, which is exposed only to atmospheric pressure. The entire quantity demanded by the fuel injection system must then be compressed by the low-pressure pump to the prefeed pressure, to enable filling of the pump chambers of the high-pressure pumping unit.

SUMMARY OF THE INVENTION

According to the provisions of the invention, to reduce the prefeed quantity, the return from the pressure booster is not depressurized completely and pumped back into the fuel tank. As proposed, a compensation container can be integrated with the return from the pressure booster, and a return line can discharge into the low-pressure circuit, for instance directly downstream of the compression-side outlet from the prefeed unit into the low-pressure circuit. As a result, the fuel quantity returning from the pressure booster can depressurize only down to the relatively low pressure level of the prefeed pump, that is, the prefeed pressure. As a result, the quantity to be pumped by the prefeed pump decreases in accordance with the pressure boosting ratio of the pressure booster.

The return from the pressure booster can be fed into the low-pressure circuit, acted upon by the prefeed pump, at any arbitrary point. The return can be fed in upstream of a fuel filter, on the one hand, to assure cleaning of the fuel, but on the other it is also possible for the pressure booster return, flowing back from the pressure booster, to be fed into the low-pressure circuit downstream of the fuel filter, to reduce the filter size. It is furthermore possible, downstream of a metering unit that is upstream of the high-pressure pumping unit, to feed the pressure booster return into the low-pressure circuit, in order to reduce the flow cross section required in a metering unit for regulating the demand of the high-pressure pumping unit. A further possible embodiment that may be mentioned is for the return from the fuel injector also to be depressurized only down to the pressure level that can be built up by the prefeed pump and to feed it into the low-pressure circuit downstream of the prefeed pump. This variant embodiment can be employed in fuel injection systems with a common rail without a pressure booster, to reduce the low-pressure pumping quantity, since depending on the design of the fuel injector and the pressure level prevailing in the common rail, the return quantity from the fuel injector may represent a considerable proportion of the total quantity. However, it is also possible to feed in only a partial quantity of the injector return into the low-pressure circuit downstream of the prefeed pump. As a result, pressure-sensitive chambers in a fuel injector or a pressure booster module, such as a magnet valve armature chamber, can continue to be depressurized down to a lesser pressure level.

BRIEF DESCRIPTION OF THE DRAWINGS

The invention will be described in further detail below in conjunction with the drawings, in which.

DESCRIPTION OF THE PREFERRED EMBODIMENTS

Figure 1:
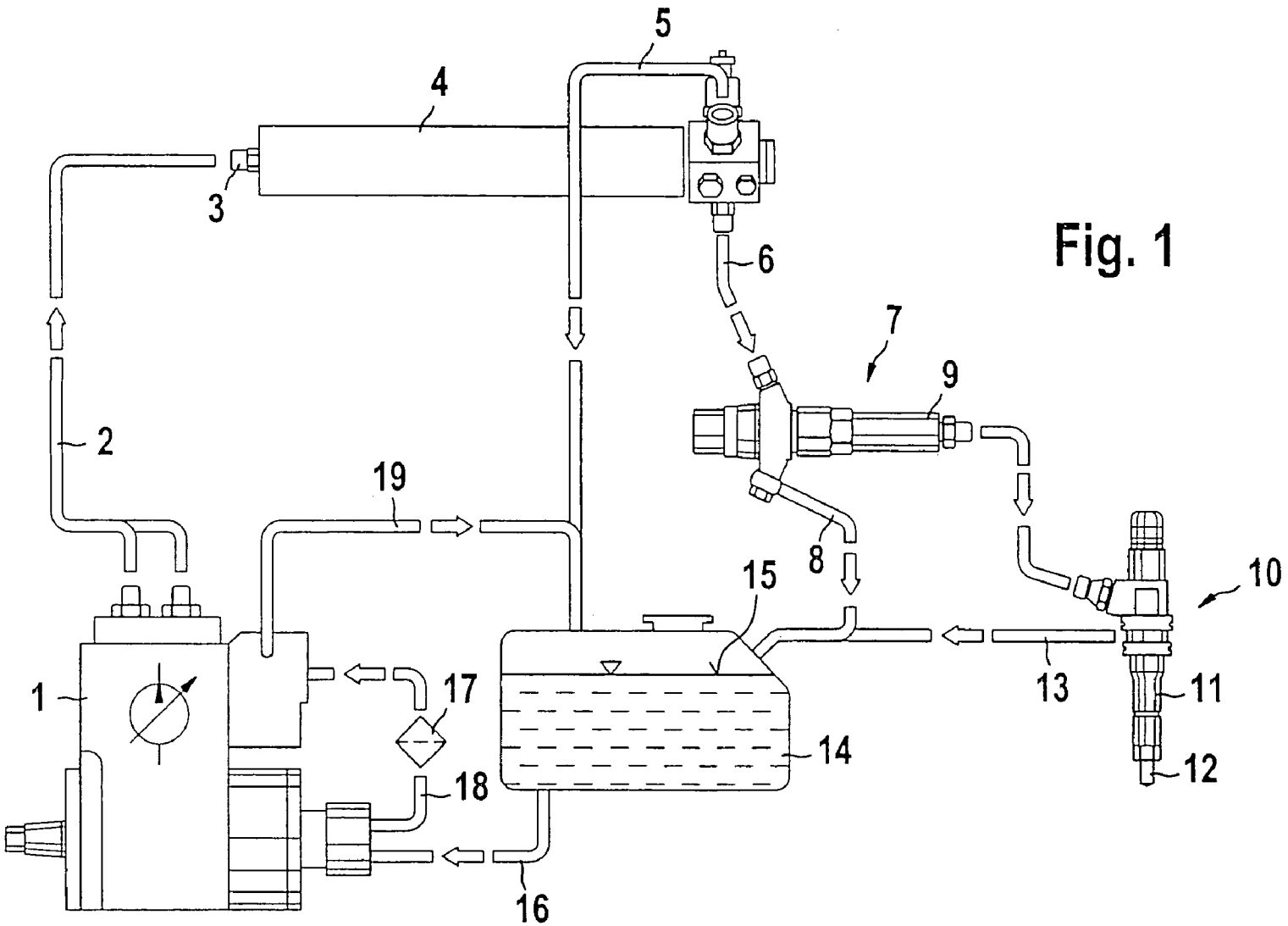
FIG. 1 is the hydraulic layout of the high-pressure and low-pressure circuits in a high-pressure common rail injection system with a pressure booster.

FIG. 1 shows the hydraulic interconnection of the components of a fuel injection system with a common rail and a pressure booster, along with the components used in it. The fuel injection system with a high-pressure reservoir or common rail 4 and a pressure booster 7 upstream of a fuel injector 10 includes a high-pressure pumping unit 1. A metering unit, not shown in further detail, precedes the high-pressure pumping unit 1, and by way of it fuel is metered as needed to the high-pressure pumping unit. From a fuel tank 14, which contains fuel whose fuel level is shown at 15, fuel flows via an inlet 16 to a prefeed pump upstream of the high-pressure pumping unit 1. The fuel is compressed in that pump to the prefeed pressure. Next, the compressed fuel travels through a fuel filter 17 and is metered, controlled by demand, by a metering unit not shown in further detail to the high-pressure pumping unit 1. Control, scavenging and lubrication quantities are returned to the fuel tank 14 via a return line 19.

The fuel compressed to the prefeed pressure is further compressed in the high-pressure pumping unit 1 and stored in the common rail 4. The high-pressure pumping unit 1 communicates with the common rail 4 via a high-pressure supply line 2 which is accommodated at a high-pressure connection 3 on the common rail 4.

From the common rail 4, fuel flows, at the pressure built up by the high-pressure pumping unit 1, via the supply line 6 to the pressure booster 7. Via a return line 5 to the fuel tank 14, the common rail 4 communicates with the fuel tank 14.

From a high-pressure chamber 9 contained in the pressure booster 7, fuel at a still further elevated pressure level flows to the fuel injector 10 and can be injected into the combustion chamber, not shown in FIG. 1, of a self-igniting internal combustion engine at an injection nozzle 12 of the fuel injector 10.

In the configuration shown in FIG. 1, all the return quantities that occur in the system, that is, the return quantity from the metering unit as well as the return quantity from the pressure booster 7 and the return quantity from the fuel injector 10, are completely depressurized and returned to the fuel tank 14. In the system configuration shown in FIG. 1, the pressure booster 7 is in the form of a separate component, but it may also be integrated with either the common rail 4 or the fuel injector 10.

The leakage or triggering quantities that are returned to the fuel tank 14, which is at atmospheric pressure, all flow back into the fuel tank 14 via the returns 13 from the fuel injector 10, the return line 8 from the pressure booster 7, the return line 5 from the common rail 4, and the return line 19 from the metering unit.

Figure 2:
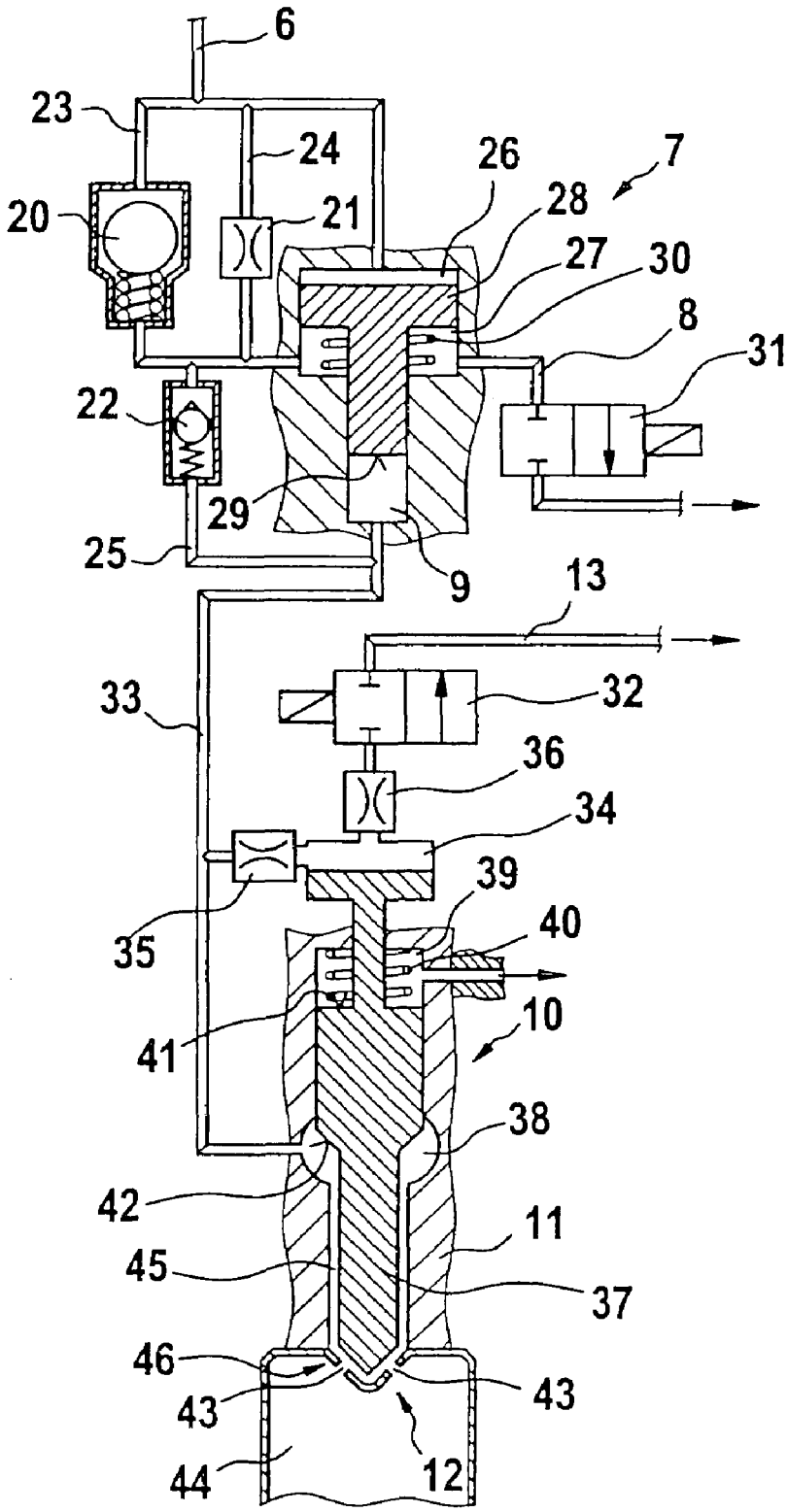
FIG. 2 is a schematic illustration of the hydraulic mode of operation of a fuel injection system with a common rail and a pressure booster.

From FIG. 2, the hydraulic mode of operation of a fuel injection system which includes a pressure booster can be seen. Via the supply line 6, fuel, which is at the pressure level prevailing in the common rail 4 (not shown here) is delivered to the pressure booster 7. The fuel flows into a work chamber 26 of the pressure booster 7 via the supply line 6. Both a first conduit 23 and a second conduit 24 extend parallel to the supply line that acts on the work chamber 26 of the pressure booster 7. A filling valve 20 is accommodated inside the first conduit 23; the second conduit 24 includes a throttle restriction 21. Both the first conduit 23 and the second conduit 24 and an overflow line 25 that contains a check valve 22 all communicate with a differential pressure chamber 27 of the pressure booster 7. A restoring spring 30 is accommodated inside the differential pressure chamber 27 and acts upon the lower face end of a booster piston 28 that divides the work chamber 26 from the high-pressure chamber 9. On the booster piston 28, there is a face end 29, which upon pressure relief of the differential pressure chamber 27 of the pressure booster 7 moves into the high-pressure chamber 9. The face end 29 that moves into the high-pressure chamber 9 upon pressure relief 27 of the pressure booster 7 brings about a still-further pressure increase of the fuel contained in the high-pressure chamber 9, in accordance with the boosting ratio of the pressure booster 7 inside the high-pressure chamber 9. A pressure relief of the differential pressure chamber 27 of the pressure booster 7 is effected by a triggering of an actuating valve identified by reference numeral 31. The actuating valve 31 for pressure relief of the differential pressure chamber 27 may for instance be embodied as a 2/2-way valve and communicates with a low-pressure region, not shown in further detail here in FIG. 2.

Upon pressure relief of the differential pressure chamber 27 via the return line 8 after actuation of the valve 31, a positive displacement of the fuel at high pressure, contained in the high-pressure chamber 9 of the pressure booster 7, is effected into a high-pressure supply line 33, which extends to the fuel injector 10. By means of the check valve 22 contained in the overflow line 25 for refilling the high-pressure chamber 9, a return flow of the fuel volume, positively displaced out of the high-pressure chamber 9, into the differential pressure chamber 27 of the pressure booster 7 is prevented.

The high-pressure supply line 33 extending from the high-pressure chamber 9 of the pressure booster 7 to the fuel injector 10 discharges into a nozzle chamber 38 embodied in the injector body 11 of the fuel injector 10. Moreover, via the high-pressure supply line 33, a control chamber 34 of the fuel injector 10 is acted upon via an inlet throttle 35. A pressure relief of the control chamber 34 for actuating an injection valve member 37, preferably embodied as a nozzle needle, is effected by the triggering of an actuating valve 32, which may be embodied as a 2/2-way valve. A pressure relief of the control chamber 34 is effected via an outlet throttle 36 into the return 13, which adjoins the actuating valve 32 for triggering the fuel injector 10.

As shown in FIG. 2, besides a nozzle chamber 38, a nozzle spring chamber 39 is provided in the injector body 11 of the fuel injector 10. The nozzle spring chamber 39 accommodates a nozzle spring 40. A leakage line, by way of which fuel flowing out of the nozzle chamber 39 upon an opening motion of the injection valve member 37 can flow away into the low-pressure region of the fuel injection system also extends from the nozzle spring chamber 39.

Via the high-pressure supply line 33, the fuel, compressed in accordance with the boosting ratio of the pressure booster 7, flows into the nozzle chamber 38. Because of the pressure buildup in the nozzle chamber 38, this boosted pressure prevails at a pressure shoulder 42, which is embodied on the injection valve member 37 in the region of the nozzle chamber 38. The injection valve member 37 is kept in its closing position via both the nozzle spring 40 and the pressure level prevailing in the control chamber 34.

Upon pressure relief of the differential pressure chamber 27 via the actuating valve 31, the booster piston 28 moves with its face end 29 into the high-pressure chamber 9. An elevated fuel pressure is reached in this chamber, in accordance with the boosting ratio of the pressure booster 7. From the high-pressure chamber 9, the fuel flows to the nozzle chamber 38 via the high-pressure supply line 33 and acts on the pressure shoulder 42 embodied on the injection valve 37. The control chamber 34 is pressure-relieved via the outlet throttle 36 upon switching of the actuating valve 32. Upon switching of the actuating valve 32, the control chamber 34 is relieved, and injection valve member 37 moves upward counter to the action of the nozzle spring 40 causing an injection of fuel into the combustion chamber 44. For the hydraulic function of the pressure boosting, it does not matter whether the fuel in the differential pressure chamber 27 of the pressure booster is depressurized completely or has a residual pressure that is approximately equivalent to the prefeed pressure. The preservation of a slight residual pressure level inside the differential pressure chamber 27 of the pressure booster is more likely advantageous, for preventing cavitation effects in the differential pressure chamber 27.

By actuation of the switching valve 31 to its closing position, that is, the interruption of the low-pressure-side communication with the return, filling of the differential pressure chamber 27 of the pressure booster 7 takes place, via the first conduit 23 and the second conduit 24. After that, the booster piston 27, reinforced by the restoring spring 30 accommodated in the differential pressure chamber 27, returns to its position of repose, so that the high-pressure chamber 9 of the pressure booster 7 is pressure-relieved. As a consequence, the pressure in the nozzle chamber 38 drops. The closing motion of the injection valve member 37, embodied as a nozzle needle, is initiated by switching the switching valve 32, which pressure-relieves the control chamber 34, into its closing position, so that a pressure buildup is effected in the control chamber 34, by way of the inlet throttle 35 that branches off from the high-pressure supply line 33.

Figure 3:
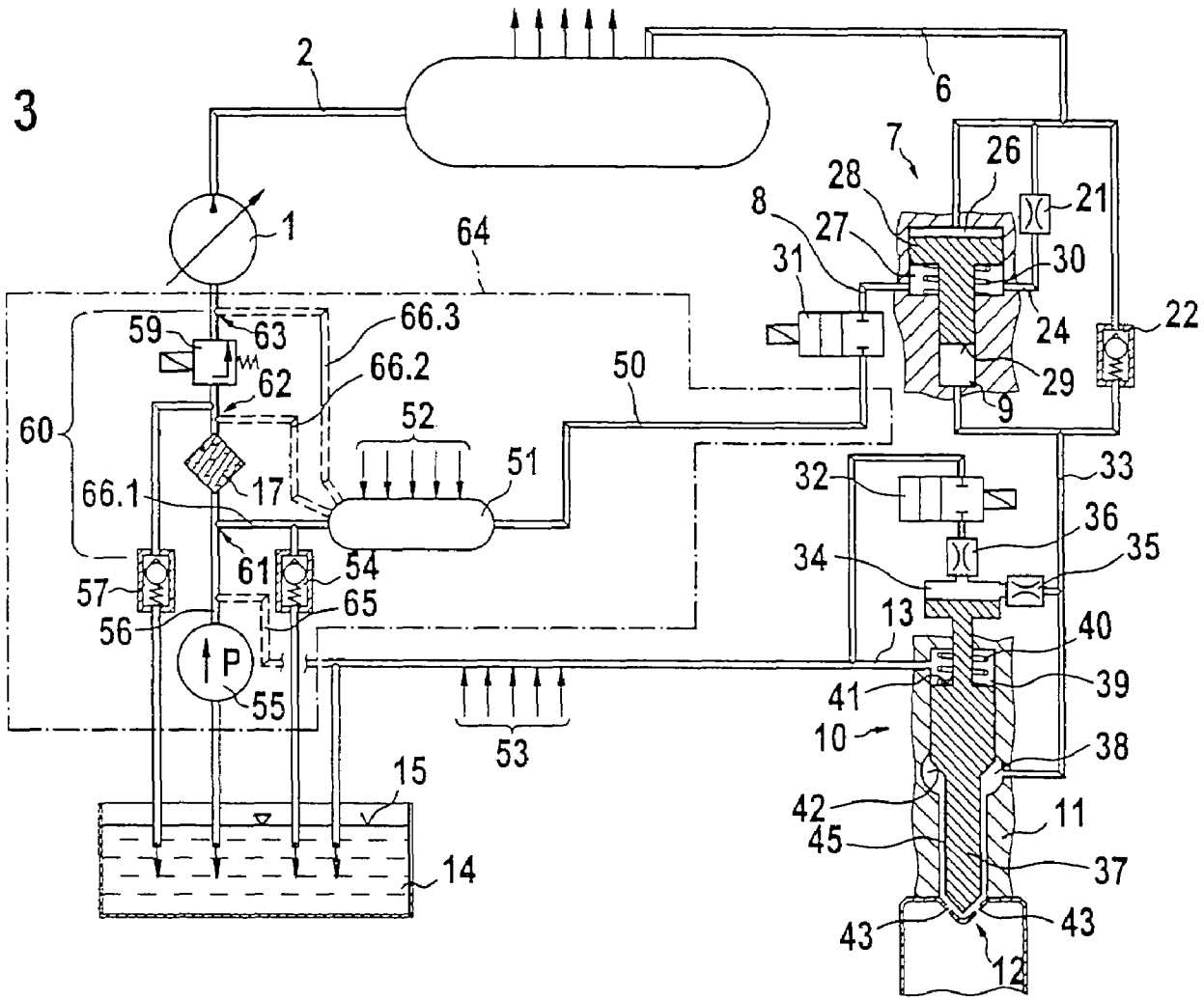
FIG. 3 is a schematic illustration of the hydraulic interconnection according to the invention of the low-pressure circuit of a fuel injection system with a pressure booster and a common rail.

FIG. 3 shows the circuitry proposed according to the invention for a low-pressure region of a fuel injection system with a pressure booster and a common rail. In this fuel injection system the high-pressure pumping unit 1, via the high-pressure line 2, pumps fuel into the common rail 4. Six supply line connections are shown for the common rail 4, and by way of them a 6-cylinder self-igniting internal combustion engine is supplied with fuel. Instead of the six high-pressure line connections shown in FIG. 3, either four, five, eight, ten or twelve high-pressure line connections may be provided on the common rail, in accordance with the number of cylinders of the engine to be supplied with fuel. Via the supply line 6 from the common rail 4, the work chamber 26 of the pressure booster 7 is subjected to pressure. The pressure booster 7 includes a booster piston 28, which divides the work chamber 26 from the differential pressure chamber 27. A restoring spring, which returns the booster piston 28 to its position of repose, may be accommodated in the differential pressure chamber 27 of the pressure booster 7. A subjection of the differential pressure chamber 27 of the pressure booster 7 to fuel is effected via the supply line 6, which discharges into the second conduit 24 that includes the throttle restriction 21. The pressure relief of the differential pressure chamber 27 is effected via the return line 8, which by means of the switching valve 31 with a return line 50, assigned to the pressure booster.

The face end 29 of the booster piston 28 acts on the high-pressure chamber 9 of the pressure booster 7, so that in it, an elevated fuel pressure can be achieved, in accordance with the pressure boosting ratio of the pressure booster 7. The check valve 22, connected parallel to the pressure booster 7 in a bypass line, prevents a return flow into the supply line 6 of the fuel volume contained in the high-pressure chamber 9 of the pressure booster 7.

The high-pressure chamber 9 of the pressure booster 7 communicates with the high-pressure supply line 33. From it, a line segment containing an inlet throttle 35 branches off to the control chamber 34, and moreover, via the high-pressure supply line 33, the nozzle chamber 38 inside the body 11 of the fuel injector 10 is acted upon by fuel at elevated pressure, that is, boosted pressure. If the fuel injector 10 is actuated by switching of the switching valve 32, fuel, that is, the injector control quantity, flows via the open outlet throttle 36 away to the return 13. At the same time, as a result of the subjection of the nozzle chamber 38 to pressure, a force acting in the opening direction of the injection valve member 37 builds up at the pressure shoulder 42, which is operative as a hydraulic surface, on the injection valve member 37. The injection valve member 37 moves upward counter to the nozzle spring 40 let into the nozzle spring chamber 39, so that the injection openings 43 of the injection nozzle 12 are opened, and from the nozzle chamber 38, via the annular gap 45 surrounding the injection valve member 37, fuel can be injected into the combustion chamber, not shown in FIG. 3, of a self-igniting internal combustion engine.

With the switching valve 32 open, the injector control quantity flows out of the control chamber 34 via the outlet throttle 36. Via the return line 13, the injector control quantity flows away into the pressureless fuel tank 14. Arrows 53 indicate further return lines 13 of the further fuel injectors 10 for supplying fuel to the self-igniting engine. These lines likewise discharge through the return 13 into the pressureless fuel tank 14. The return 50 associated with the pressure booster 7, however, discharges into a compensation container 51 inside a low-pressure circuit 64 of the fuel injection system shown in FIG. 3. Arrows 52 indicate further pressure booster returns 50, associated with further pressure boosters 7, which also flow back into the compensation container 51. For the hydraulic function of the pressure booster 7, it does not matter whether the fuel in the differential pressure chamber 27 of the pressure booster 7 is depressurized completely or to a residual pressure approximately equivalent to the pressure built up by a prefeed pump 55. A slight residual pressure in the differential pressure chamber 27 of the pressure booster 7 is more likely to be advantageous, for avoiding cavitation effects.

Upon depressurization of the differential pressure chamber 27 to a residual pressure, which is approximately equivalent to the pressure level attainable with a prefeed pump 55 on the low-pressure side, fuel flows from the compensation container 51 into a line segment 60. The line segment 60 includes a plurality of infeed points 61, 62, 63, where the fuel, at residual pressure, in the compensation container 51 can be fed back into the low-pressure circuit 64, that is, upstream of the high-pressure pumping unit 1.

A first possibility is for the fuel at residual pressure to be fed from the compensation container 51 into the line segment 60 at a first infeed point 61, located downstream of the outlet 56 on the compression side of the prefeed pump 55. A first infeed portion 66.1 can be provided for this purposed. All of the infeed points 61, 62 and 63 are downstream of the compression side 56 of the prefeed pump 55, so that the fuel volume to be pumped by the prefeed pump 55 is reduced considerably. This is due to the fact that the pressure booster 7 produces relatively high return quantities, which are the product of the boosting ratio multiplied by the injection quantity. In the compensation container 51, in which the return quantities of the pressure booster 7 are accommodated, pressure fluctuations in the return path of the pressure boosters 7 can be damped. Moreover, the compensation container 51 develops a certain cooling action, which favorably influences the temperature level of the fuel inside the low-pressure circuit 64.

For safety purposes, an overpressure valve 54 is provided downstream of the compensation container 51, in the direction of outflow of the fuel contained in the compensation container. This overpressure valve 54, analogously to the returns 13 extending from the fuel injectors 10, communicate with the pressureless fuel tank 14. The return quantity originating in the six pressure boosters 7 of a six-cylinder self-igniting engine may be fed into the line segment 60 at a first infeed point 61. If the fuel quantities diverted from the pressure boosters 7 upon pressure relief of the differential pressure chambers 27 are fed in upstream of the fuel filter 17, then advantageously, cleaning of the diverted return quantities from the pressure boosters 7, 52 can be achieved. Alternatively, it is possible for the return quantities from the pressure boosters 7, accommodated in the compensation container 51, to be fed in at a second infeed point 62, which is downstream of the fuel filter 17. Feeding the return quantities from the pressure boosters 7 in at the second infeed point 62 via a second infeed portion 66.2 offers the advantage that the size of the fuel filter 17 can be reduced, which is favorable in terms of the structural volume.

The return quantities flowing back into the compensation container 51 from the pressure boosters 7 can finally also be delivered at a third infeed point 63 via a third infeed portion 66.3 into the introduction portion 60 in the low-pressure circuit 64. The third infeed point 63 is downstream of a metering unit 59, which takes on the metering of fuel to the high-pressure pumping unit 1 outside the low-pressure circuit 64 in a demand-controlled fashion. By means of a third infeed point 63 downstream of the metering unit 59, it can be attained that the return quantities from the pressure boosters 7 are introduced into the introduction portion 60 downstream of the metering unit 59, which is upstream of the high-pressure pumping unit 1 outside the low-pressure circuit 64, so that the requisite flow cross section of the metering unit 59 can be kept small. By feeding the return quantity, contained in the compensation container 51, from the pressure boosters 7 in the introduction portion 60, the volumetric flow of fuel to be pumped by the prefeed pump 55 can be reduced considerably in all three feeding variants, that is, positions 61, 62 and 63. This makes a smaller size of the prefeed pump 55 possible, since the line output to be produced by the prefeed pump 55, in terms of the volumetric flow of fuel that is delivered to the high-pressure pumping unit 1 outside the low-pressure circuit 64, is supplemented by the return quantities, diverted from the pressure boosters 7 and delivered from the compensation container 51 inside the introduction portion 60 to the infeed points 61, 62, 63. The pressure level prevailing in the low-pressure circuit 64, which level is built up by the prefeed pump 55, is preferably in the range between 5 and 7 bar, which corresponds to the residual pressure level that remains in the differential pressure chamber 27 upon relief of the differential pressure chamber 27 of the pressure booster 7 upon triggering of its actuating valve 31. Pressure fluctuations inside the introduction portion 60 can be compensated for by a pressure regulating valve 57, which is accommodated in a line segment that discharges into the fuel tank 14 and that branches off inside the introduction portion 60, between the fuel filter 17 and the metering unit 59.

By means of the configuration, proposed according to the invention, of the low-pressure circuit 64 of the fuel injection system in accordance with FIG. 3, it is furthermore possible, when the fuel volume flowing out of the compensation container 51 is delivered to the second infeed point 62 immediately downstream of the fuel filter 17, to design the fuel filter 17, for smaller volumetric flows of fuel, which has a very favorable effect on the structural size of pump components and filter components inside the low-pressure circuit 64 of the fuel injection system proposed according to the invention.

A further reduction in the volumetric flow of fuel to be delivered to the high-pressure pumping unit 1 by the prefeed pump 55, the filter 17 and the metering unit 59 can be implemented by depressurizing the leakage quantity, flowing as shown in FIG. 3 into the fuel tank 14 via the return line 13 assigned to the fuel injectors 10 and via a partial-quantity return 65, likewise only down to the prefeed pressure to be produced by the prefeed pump 55. This volumetric flow of fuel, flowing away from the fuel injector 10 or fuel injectors 10 via the return line 13, is preferably fed into the low-pressure circuit 64 downstream of the compression side 56 of the prefeed pump 55. As a result, even in fuel injection systems that are embodied without pressure boosters, the fuel quantity to be pumped by the prefeed pump 55 can be reduced. Depending on the design of the fuel injectors 10 and on the fuel pressure produced in the common rail 4 by the high-pressure pumping unit 1, the return quantity from the fuel injector or fuel injectors 10 may make up a considerable proportion of the total fuel quantity. The return quantity flowing away from the fuel injector 10 is composed essentially of the volumetric flow of fuel diverted into the nozzle spring chamber 39 upon the opening motion of the injection valve member and the control volume flowing out of the control chamber 34 via the outlet throttle 36 upon actuation of the switching valve 32. In the fuel injection system shown in FIG. 3 for supplying a 6-cylinder self-igniting internal combustion engine, the returns 53 from further fuel injectors 10, which are not shown in detail here, are represented by arrows pointing to the return line 13.

With the configuration proposed according to the invention of the low-pressure circuit 64 of a fuel injection system, a complete depressurization of the large return quantity flowing back from the pressure boosters 7, which can amount to multiple times the injection quantity, to atmospheric pressure can be avoided. In previously known pressure boosters, this return quantity is depressurized completely and returned to the pressureless fuel tank 14. After that, the entire quantity needed in this system must be compressed by the prefeed pump 55 to the prefeed pressure (5 to 7 bar) to assure filling of the pump chambers of the high-pressure pumping unit 1. If conversely the return quantity flowing back from the pressure boosters 7 is not completely depressurized, but instead is kept at a pressure equivalent to the prefeed pressure of the prefeed pump 55 and is delivered back to the low-pressure circuit 64 at the first infeed point 61, the second infeed point 62 and the third infeed point 63 inside the introduction portion 60, then the fuel filter 17 or 58 can be designed and the metering unit 59 and prefeed pump 55 can be dimensioned for lesser volumetric flows. Although the lesser pumping output of the prefeed pump 55 is as a rule not designed for demand-oriented regulation, the high overflow quantities that occur in certain performance graph pumps and that can contribute to a not inconsiderable loss of efficiency of the entire fuel injection system can be avoided.

The foregoing relates to a preferred exemplary embodiments of the invention, it being understood that other variants and embodiments thereof are possible within the spirit and scope of the invention, the latter being defined by the appended claims.

The foregoing relates to a preferred exemplary embodiments of the invention, it being understood that other variants and embodiments thereof are possible within the spirit and scope of the invention, the latter being defined by the appended claims.

The invention claimed is:

1. In a fuel injection system for an internal combustion engine, the system including a high-pressure fuel source (1, 4), a fuel injector (10) which can be supplied with fuel from a high-pressure fuel source (1, 4) including a high-pressure pumping unit (1) and which includes an injection valve member (37) for opening or closing injection openings (43), and a low-pressure circuit (64) including a prefeed pump (55) which pumps fuel from a fuel tank (14), the improvement comprising return conduits (50, 52; 13, 53) for delivering partial return fuel quantities, depressurized to the prefeed pressure of the prefeed pump (55), to the low-pressure circuit (64) from pressure boosters (7, 52) or from fuel injectors (10), the partial return fuel quantities being delivered inside an infeed portion (60) wherein the low-pressure circuit (64) comprises a compensation container (51) acted upon by the returns (50, 52) from the pressure booster (7).

2. The fuel injection system of claim 1, wherein the high-pressure fuel pumping unit (1) subjects a common rail (4) to fuel that is at high pressure.

3. The fuel injection system of claim 1, wherein the low-pressure circuit (64) comprises a fuel filter (17) and a fuel metering unit (59).

4. The fuel injection system of claim 3, further comprising a first infeed portion (66.1) extending from the compensation container (51) to a first infeed point (61) in the infeed portion (60), which point is located upstream of the fuel filter (17).

5. The fuel injection system of claim 3, further comprising a second infeed portion (66.2) extending from the compensation container (51) to a second infeed point (62) in the infeed portion (60), which point is located downstream of the fuel filter (17).

6. The fuel injection system of claim 3, further comprising a third infeed portion (66.3) extending from the compensation container (51) to a third infeed point (63) in the infeed portion (60), which point is downstream of the metering unit (59).

7. The fuel injection system of claim 4, further comprising a second infeed portion (66.2) extending from the compensation container (51) to a second infeed point (62) in the infeed portion (60), which point is located downstream of the fuel filter (17), and a third infeed portion (66.3) extending from the compensation container (51) to a third infeed point (63) in the infeed portion (60), which point is downstream of the metering unit (59), the infeed portions (66.1, 66.2, 66.3) each being secured against the fuel tank (14) via a respective overpressure valve (54).

8. The fuel injection system of claim 1, wherein the infeed portion (60) extends from the compression side (56) of the prefeed pump (55) to the high-pressure pumping unit (1).

9. The fuel injection system of claim 3, wherein the fuel filter (17) and the metering unit (59) for the high-pressure pumping unit (1) are located inside the infeed portion (60).

10. The fuel injection system of claim 1, wherein both injector control quantities and leakage quantities from the fuel injectors (10) are delivered to the low-pressure circuit (64) via a return (13, 53) inside the infeed portion (60) downstream of the prefeed pump (55).

11. The fuel injection system of claim 1, wherein the pressure booster (7) is integrated with the common rail (4).

12. The fuel injection system of claim 1, wherein the pressure booster (7) is integrated with the fuel injector (10).

13. The fuel injection system of claim 1, wherein the prefeed pressure of the prefeed pump (55) is between 4 and 8 bar.

14. The fuel injection system of claim 1, wherein a pressure change in a differential pressure chamber (27) of the pressure booster (7, 52) causes a pressure change in the high-pressure chamber (9) of the pressure booster (7, 52).

* * * * *